US005579714A

United States Patent [19]

Hemphill

[11] Patent Number: 5,579,714

[45] Date of Patent: Dec. 3, 1996

[54] DIVER'S DOOR FOR INFLATABLE BOAT

[75] Inventor: Douglas Hemphill, Richmond, Canada

[73] Assignee: Zodiac Hurricane Technologies, Inc., Richmond, Canada

[21] Appl. No.: 510,671

[22] Filed: Aug. 3, 1995

[51] Int. Cl.[6] ..... B63B 7/08

[52] U.S. Cl. ..... 114/345; 114/362

[58] Field of Search ..... 114/345, 362; 441/39, 40

[56] References Cited

U.S. PATENT DOCUMENTS

| | | | |
|---|---|---|---|
| 1,867,563 | 7/1932 | Clarke | 114/345 |
| 3,781,933 | 1/1974 | Soter | 114/345 |
| 3,931,655 | 1/1976 | Luscombe | 114/345 |
| 4,159,551 | 7/1979 | Iwai | 114/345 |
| 4,329,751 | 5/1982 | Cigognetti | 114/345 |
| 4,449,473 | 5/1984 | McCrory et al. | 114/354 |
| 4,498,413 | 2/1985 | Cochran | 114/345 |
| 4,989,691 | 2/1991 | Wilkerson et al. | 114/362 X |
| 5,170,738 | 12/1992 | Patten | 114/345 |

FOREIGN PATENT DOCUMENTS

| | | | |
|---|---|---|---|
| 404100793 | 4/1992 | Japan | 114/362 |

*Primary Examiner*—Sherman Basinger
*Attorney, Agent, or Firm*—Larson & Taylor

[57] ABSTRACT

A diver's door which provides easy access to and from an inflatable boat for a diver and which can be replaced to minimize water leakage into the deck of the boat, is described. The diver's door includes a removable support section including a device for releasably attaching the support section to the deck of a boat and a corresponding removable tube element attached to the removable support section to form a single unit removable from the deck of a boat. Also disclosed are an inflatable boat including the diver's door of the present invention and a method for providing access to an inflatable boat using the diver's door of the present invention.

20 Claims, 2 Drawing Sheets

DIVER'S DOOR FOR INFLATABLE BOAT

BACKGROUND OF THE INVENTION

1. Field of the Invention

The present invention relates to a diver's door for use on inflatable boats in order to provide access to the boat.

2. Description of the Prior Art

Numerous examples of inflatable boats are known in the art. Several inflatable boats are formed from separable sections such as that disclosed in U.S. Pat. No. 4,159,551 (Iwai). This separable inflatable boat is formed from a covering having a hollow peripheral casing and a flat deck and a floatable member accommodated in the casing. The floatable member includes a plurality of floatable bags which are separably interconnected by slide fasteners and can be conveniently carried separately from the covering. This boat, however, has no provision for removing a section of the boat during use in order to improve diver access thereto.

U.S. Pat. No. 3,931,655 (Luscombe) discloses an inflatable boat of sectional construction including a bow section, an intermediate section and a stern section which are releasably secured together. Each section includes inflatable side members that are generally rectangular and which form the sides of the boat. Inflatable transverse members of each section are secured together and serve as seats for the boat. The sections may be readily disconnected from each other and each section may then serve as a small buoyant craft. Again, this boat has no provision for removing a portion of the side wall in order to improve diver access but rather is separable into three distinct boats.

U.S. Pat. No. 4,449,473 (McCrory et al.) discloses an inflatable boat having parallel side sponsors joined by a floor and having a rigid keelson member including a demountable transom capable of supporting an outboard motor. The transom may be removed from the boat for storage but no provision is made for removal of the transom from the boat during use.

U.S. Pat. No. 5,170,738 (Patten) discloses an inflatable vessel for marine divers having an opening in the fabric bottom or deck to enable divers to board the vessel from the water through the opening without swamping the vessel. The advantage of this particular boat is that no rigid framework is required. However, this boat requires that the deck or bottom be suspended above the water line in order to prevent flooding of the interior of the boat when the access opening is opened.

U.S. Pat. No. 5,170,738 also mentions that existing vehicles available for use in similar operations may be partially rigid with an inflatable tube supporting a rigid frame which forms a well for entry. Such boats suffer from the disadvantage, however, that the entry well cannot be closed and thus typically provides a means for ingress of water to the boat through the well during use.

U.S. Pat. No. 3,781,933 (Soter) discloses a one-man inflatable life raft with an inflatable tube peripherally bounding an occupant receiving space having a flexible floor member. The boat includes a zippered opening in the floor to be used for entry thus avoiding the necessity of climbing over the peripheral tube and facilitating the use of a constant diameter tube as opposed to conventional tubes that are tapered at one end to facilitate boarding over the side. Again, this boat suffers from the disadvantage that water will enter the boat when the zippered opening in the floor is opened thereby swamping the boat or at least wetting the contents of the boat.

U.S. Pat. No. 4,498,413 (Cochran) discloses a rigid inflatable boat including multiple inflatable bladders defining a ring around the hull generally at or above the water line. The inflatable bladders are connected to the hull and to each other in a manner facilitating rapid mounting and demounting and easy repair thereof. This is accomplished by a positioning structure formed in the hull for positioning each bladder with respect to the hull and a holding structure to releaseably hold each bladder to the hull when the bladder is inflated while allowing ready demounting when the bladder is deflated. The bladders may be provided with interlocking end structures to stabilize the positions of the bladders with respect to each other and the hull.

U.S. Pat. No. 4,498,413 does not contemplate removal of one or more sections of the boat during use in order to facilitate entry or exit of a diver to or from the boat but rather is designed solely for the purpose of facilitating disassembly of the boat for repair or replacement of one or more of the inflatable bladders.

Accordingly, there is a need in the art for an inflatable boat which provides for easy access to the boat by a diver while at the same time does not unduly expose the interior of the boat to the water.

Thus, it is the primary object of the present invention to provide an inflatable boat including a means for providing access to the boat for a diver while at the same time not exposing the boat to ingress of water.

This and other objects of the present invention will be apparent from the summary and detailed descriptions which follow.

SUMMARY OF THE INVENTION

In a first aspect, the present invention relates to a diver's door for a rigid inflatable boat which includes a removable support section including a means for releasably attaching the support section to the deck of a boat and an inflatable support element attached to the support section such that the tube element and the removable support section are removable as a single unit from the deck of a boat.

In a second aspect, the present invention relates to an inflatable boat including a deck, a rigid support attached to the deck and a plurality of inflatable tube elements which are attached the rigid support and extending at least partially around the deck as from sidewalls of the boat. At least one of the inflatable tube elements and a corresponding section of the rigid support are removable as a single unit to create a space in the sidewall of the boat to permit passage of a diver into or out of the boat through said space.

A third embodiment of the present invention relates to a method of providing access to an inflatable boat having a deck provided with a plurality of inflatable tube elements and a rigid support which together extend at least partially around the deck to form sidewalls of the boat with a section of the rigid support and a corresponding tube element being removable as a single unit from the deck The method includes the steps of partially deflating the removable inflatable tube element and removing the removable section of the tube element and the corresponding removable inflatable tube element from the deck of the boat to provide a space in the sidewall.

The present invention provides an apparatus and method for providing access for a diver to an inflatable boat while minimizing the exposure of the deck of the boat to ingress of water. In this manner, the problem of the prior art inflatable boats has been solved.

DETAILED DESCRIPTION OF THE PREFERRED EMBODIMENTS

In the following description, like numerals represent like elements throughout the several views.

Figure 1:
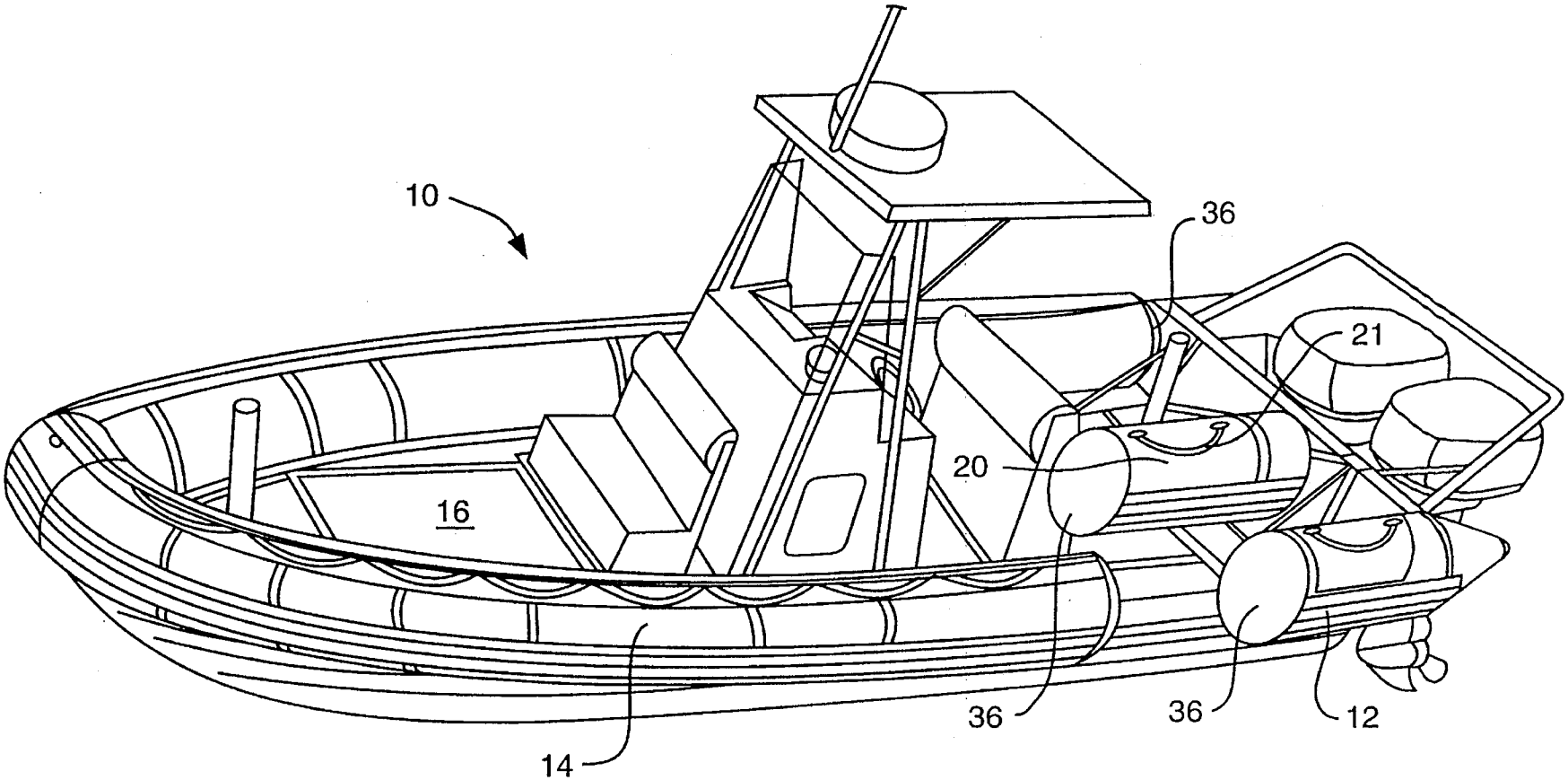
FIG. 1 depicts an inflatable boat as seen from outside of the boat and including the diver's door of the present invention shown displaced from its position on the deck.

Referring to FIG. 1, there is shown an inflatable boat 10 which includes a first inflatable tube element 12, located at the stern of the boat 10 and extending along one side thereof and a second inflatable tube element 14 extending along the remainder of the one side of the boat 10 and continuing around the bow and the other side of the boat 10 to the opposite side of the stern. Both tube elements 12 and 14 are attached to the deck 16. Apart from a deflatable tube element 20 described in more detail below, boat 10 is otherwise conventional and thus further description of the boat per se will be dispensed with.

Also shown in FIG. 1 is the displaceable tube element 20 which is depicted out of its position between first inflatable tube element 12 and second inflatable tube element 14. Tube elements 12, 14 and 20 together form the sidewalls of inflatable boat 10. As can be seen from FIG. 1, removal of the displaceable chamber 20 creates an opening between first inflatable tube element 12 and second inflatable tube element 14 through which a diver may enter or leave inflatable boat 10. Displaceable chamber 20 preferably has a length of less than 20% of the total length of the sidewalls of the boat and, more preferably, has a length of less than 15% of the total length of the sidewalls of the boat.

Each of the inflatable tube elements 12, 14 and displaceable tube elements 20 include end caps 36 on the ends thereof. End caps 36 are typically formed from a fabric material and end caps 36 serve to define the form of the inflatable tube elements 12, 14 and 20 so well as provided structural stability thereto.

Also shown in FIG. 1 is a handle means 21 attached to displaceable tube element 20. Handle means 21 is employed for grasping the displaceable tube element 20 and removing it from its position between inflatable tube element 12, 14. Handle means 21 may be a short length of rope fastened at both ends as shown in FIG. 1, or it may be any other suitable handle means such as a plastic handle, two rings attached to the displaceable tube element 20 or any other known means for grasping objects.

Figure 2:
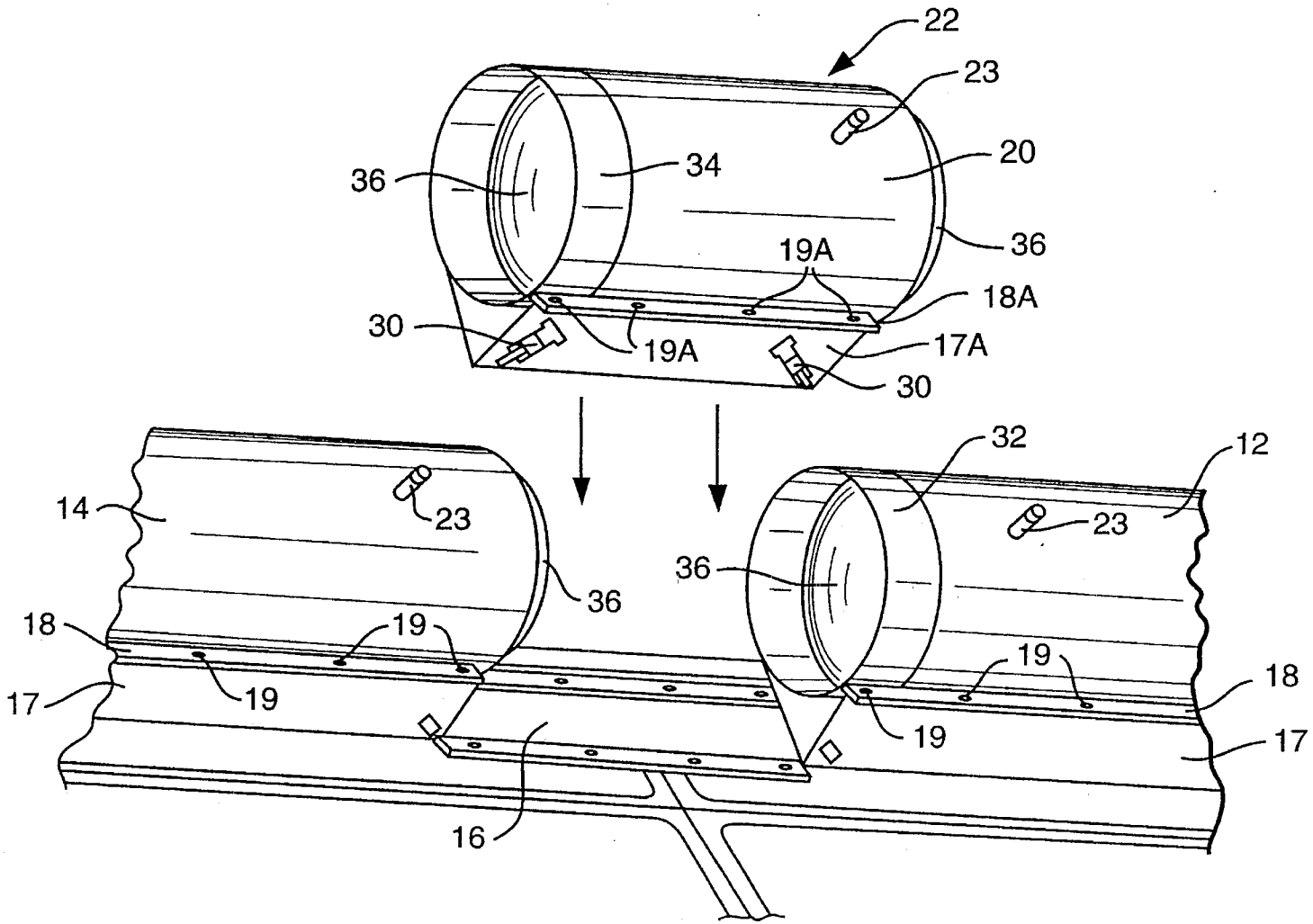
FIG. 2 is an enlarged view of the section of the inflatable boat of FIG. 1, as seen from inside the boat, which includes the diver's door which is again shown displaced from its position on the deck.

Referring now to FIG. 2, there is shown a close-up view of the area of inflatable boat 10 which includes the diver door 22 as seen from inside inflatable boat 10 looking towards the outside.

FIG. 2 shows that inflatable tube element 12, 14 are attached to deck 16 via tube cradle 17. Tube cradle 17 includes a removable tube cradle section **17*a* which is attached to displaceable inflatable tube elements 20. Inflatable tube elements 12, 14 are provided with attachment flanges 18 which may be attached to tube cradle 17 using screws 19 or any other suitable means such as bolts, for example. Displaceable inflatable tube element 20 also includes an attachment flange 18*a* which is attached to removable tube cradle section 17*a* by screws 19*a*** or any other suitable means.

Removable tube cradle section **17*a* is releasably attachable to deck 16 by two overcenter latches 30. Any other suitable means for releasably attaching removable tube cradle section 17*a* to deck 16 may be employed in place of overcenter latches 30**.

First inflatable tube element 12 further includes a first hoop flange 32 located at the end of first inflatable tube element 12 which is adjacent to diver door 22. First hoop flange 32 provides additional structural stability to first inflatable tube element 12 and displaceable inflatable tube element 20 while also substantially preventing passage of water between first inflatable tube element 12 and displaceable inflatable tube element 20.

Diver door 22 also includes a second hoop flange 34 which is adapted to fit around the adjacent end of second inflatable tube element 14 to thereby provide additional structural stability to the boat and substantially prevent passage of water between displaceable inflatable tube element 20 and second inflatable tube element 14. Hoop flanges 32, 34 are typically formed from a semi-rigid material. Finally, inflatable tube elements 12, 14, 20 each include a means for wholly or partially inflating/deflating 23 the tube elements 12, 14, 20. The inflating/deflating means 23 may be any conventional means known for this purpose such as valve.

In operation, diver door 22 including displaceable inflatable tube element 20 is provided in partially or completely deflated form. The partially or completely deflated diver door 22 is inserted in position between inflatable tube elements 12, 14 with end cap 36 of displaceable inflatable tube element 20 positioned within hoop flange 32 of inflatable tube element 12. At this point, overcenter latches 30 are closed to releasably attach removable tube cradle section **17*a* to deck 16**.

Then, displaceable inflatable tube element 20 is inflated to its fully inflated condition whereby fills the opening between inflatable tube elements 12, 14 and forces hoop flange 34 over end cap 36 of second inflatable tube element 14.

To remove diver door 22 from inflatable boat 10, displaceable inflatable tube element 20 is partially or completely deflated using inflating/deflating means such that hoop flange 34 no longer encircles second inflatable tube element 14 at which point overcenter latches 30 are released and diver door 22 is grasped and removed from its position between inflatable chambers 12, 14 to create an opening through which a diver may enter or leave inflatable boat 10. The foregoing specification has been presented for the purpose of illustration and description only and is not to be construed as limiting the invention in any way. The scope of the invention is to be determined from the claims appended hereto.

What is claimed is:

1. A diver's door for a rigid inflatable boat having a deck, said diver's door comprising a removable support section including means for releasably attaching the removable support section to the deck of the boat, an inflatable tube element which forms a section of a sidewall of the boat attached to the removable support section such that the inflatable tube element and the removable support section are displaceable as a single unit from the deck of the boat to provide a space in the sidewall of the boat which is large enough to permit a diver to enter or leave the boat through said space, and means for at least partial deflation of the inflatable tube element to facilitate removal of the tube element and support section from the deck of the boat.

2. A diver's door device as claimed in claim 1, which further comprises end caps integrally formed at each end of the inflatable tube element for providing form and structural stability to the inflatable tube element when in its fully inflated form.

3. A diver's door device as claimed in claim 2, further comprising at least one hoop flange attached circumferentially to one end of the inflatable tube element, said hoop flange being adapted to fit around an adjacent inflatable tube element of a boat in order to increase the structural stability of the boat and substantially prevent entry of water between adjacent inflatable tube elements.

4. A diver's door as claimed in claim 1, wherein the inflatable tube element further comprises at least one attachment flange for affixing the inflatable tube element to the removable support section.

5. An inflatable boat comprising a deck having a perimeter, a rigid support attached to the deck and extending at least partially around the perimeter of the deck, and a plurality of inflatable tube elements attached to the rigid support along a substantial portion of the perimeter of the deck to form sidewalls of the boat, at least one of the tube elements and a corresponding section of the rigid support to which said at least one tube element is attached comprise a single removable unit including means for releasably attaching the unit to the deck so upon removal of the unit from the deck a space is created in the sidewalls formed by the plurality of inflatable tube elements to permit passage of a diver into or out of the boat through the space.

6. An inflatable boat as claimed in claim 5, wherein the at least one removable unit has a length of less than 20% of the total length of the sidewalls of the boat.

7. An inflatable boat as claimed in claim 5, wherein the at least one removable unit has a length of less than 15% of the total length of the sidewalls of the boat.

8. An inflatable boat as claimed in claim 7, wherein the deck is made of a rigid material.

9. An inflatable boat as claimed in claim 5, further comprising a means for substantially preventing passage of water between the tube element of the removable unit and at least two adjacent tube elements when said tube element of the removable unit is positioned between said adjacent tube elements and is fully inflated.

10. An inflatable boat as claimed in claim 9, wherein said means for preventing passage of water comprises a pair of hoop flanges, one extending substantially around a first end of the tube element of the removable unit and being affixed to a first adjacent tube element, and the other being affixed to the second end of the tube element of the removable unit and extending around the adjacent end of a second adjacent tube element.

11. An inflatable boat as claimed in claim 10, further comprising a locking means for releasably attaching the removable unit to the deck of the boat.

12. An inflatable boat as claimed in claim 11, wherein the tube element of the removable unit comprises at least one attachment flange for affixing said tube element to the rigid support section.

13. An inflatable boat as claimed in claim 12, wherein the at least one attachment flange is releasably attached to the rigid support section by a releasable attachment means.

14. An inflatable boat as claimed in claim 13, wherein the releasable attachment means is selected from screws and bolts.

15. An inflatable boat as claimed in claim 9, wherein each end of the tube element of the removable unit is provided with an end cap of fabric material which imparts strength, form and durability to the tube element.

16. An inflatable boat as claimed in claim 9, wherein the removable unit further comprises a handle means.

17. An inflatable boat is claimed in claim 5 wherein the tube elements further comprise a means for at least partially deflating the tube elements.

18. An inflatable boat is claimed in claim 5 wherein the rigid support is a tube cradle.

19. A method of providing access to an inflatable boat having a deck provided with a plurality of inflatable tube elements including means for inflating and deflating said tube elements and a rigid support which together with the tube elements extends at least partially around the deck to form sidewalls of the boat, with a section of the rigid support and a corresponding tube element being removable as a single unit to provide a space in the sidewall of the boat large enough to permit a diver to enter or leave the boat through said space, said method comprising the steps of:

at least partially deflating the removable tube element; and, removing the removable unit from the deck of the boat to provide a space in the sidewall which is large enough to permit a diver to enter or leave the boat through said space.

20. A method in accordance with claim 19, wherein the removable unit further comprises a means for releasably attaching the removable unit to the deck of the boat and further comprising the step of releasing the releasable attachment means to detach the removable unit from the deck prior to the step of removing the removable unit.

* * * * *